US007912626B2

(12) United States Patent
Usukura

(10) Patent No.: US 7,912,626 B2
(45) Date of Patent: Mar. 22, 2011

(54) MOTORCYCLE PROVIDED WITH ENGINE SETTING SYSTEM

(75) Inventor: Yasutaka Usukura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/507,337

(22) Filed: Jul. 22, 2009

(65) Prior Publication Data

US 2010/0076669 A1 Mar. 25, 2010

(30) Foreign Application Priority Data

Sep. 19, 2008 (JP) ..... 2008-241599

(51) Int. Cl.
*F02D 45/00* (2006.01)

(52) U.S. Cl. ..... 701/115; 701/110

(58) Field of Classification Search ..... 701/102, 701/110, 113–115; 180/65.21, 65.265, 218, 180/219

See application file for complete search history.

(56) References Cited

U.S. PATENT DOCUMENTS 3,971,977 A * 7/1976 Hirt et al. ..... 322/1
5,526,786 A * 6/1996 Beck et al. ..... 123/357
5,671,433 A * 9/1997 Fung et al. ..... 712/43
5,983,156 A * 11/1999 Andrews ..... 701/115
6,125,326 A * 9/2000 Ohmura et al. ..... 701/213
6,151,549 A * 11/2000 Andrews et al. ..... 701/115
6,539,299 B2 * 3/2003 Chatfield et al. ..... 701/104
6,681,752 B1 * 1/2004 Kreikemeier et al. ..... 123/683
7,065,432 B2 * 6/2006 Moisel et al. ..... 701/1
2006/0054375 A1 * 3/2006 Kakinuma ..... 180/282
2007/0221169 A1 * 9/2007 Konno ..... 123/400
2008/0071472 A1 * 3/2008 Yamada ..... 701/209
2008/0140298 A1 * 6/2008 Morimoto et al. ..... 701/103

FOREIGN PATENT DOCUMENTS

JP 2008-019843 1/2008

* cited by examiner

*Primary Examiner* — Stephen K Cronin
*Assistant Examiner* — Johnny H Hoang
(74) *Attorney, Agent, or Firm* — Squire, Sanders & Dempsey (US) LLP

(57) ABSTRACT

A motor vehicle includes an engine and an external setting unit configured to set an engine control amount. A control unit is configured to store a basic control map having a preset engine control amount contained therein. The control unit is also configured to communicate with the external setting unit. An engine setting system is configured to change the preset engine control amount by replacing the preset engine control amount with the engine control amount set by the external setting unit. The engine control amount set by the external setting unit is reflected in the basic control map. The engine control amount set by the external setting unit is reflected in the control map when a start preparing operation is detected.

14 Claims, 4 Drawing Sheets

MOTORCYCLE PROVIDED WITH ENGINE SETTING SYSTEM

BACKGROUND

1. Field

The present invention relates to a motorcycle provided with an engine setting system.

2. Description of Related Art

Generally, an ECU is a control device for a motorcycle which stores a control map mapping data on an fuel injection quantity, an ignition timing, an air-fuel ratio, etc., so that an engine can be operated in an optimum state. There has been known a technology in which a target engine control amount set in the control map is required to be varied in such a manner that it matches a user's preferences, communication between an external setting means and the ECU is performed and the control map stored in the ECU is rewritten into a new control map stored in the external setting means, thus enabling engine setting so as to match the user's preferences. Such a technology is described in JP-A No. 2008-19843.

However, in the above-mentioned related art, when the control map rewritten so as to match the user's liking is reflected in a vehicle, there is a possibility that the use of the written control map exerts an effect on startability of an engine differently from the case where the control map previously stored in the ECU is used. That is, according to the degree of a change in a control amount of the engine, for example, in a case where setting making great account of running is performed, there is a problem that the startability will be impaired.

Therefore, it is desirable to provide a motorcycle provided with a setting system which can carry out setting without exerting any effect on startability.

SUMMARY

In one embodiment, the invention includes a motor vehicle having an engine, and an external setting unit configured to set an engine control amount. A control unit is configured to store a basic control map having a preset engine control amount contained therein. The control unit is also configured to communicate with the external setting unit. An engine setting system is configured to change the preset engine control amount by replacing the preset engine control amount with the engine control amount set by the external setting unit. The engine control amount set by the external setting unit is reflected in the basic control map. The engine control amount set by the external setting unit is reflected in the engine control map when a start preparing operation is detected.

In another embodiment, the invention includes a method of controlling an engine. The method includes storing a basic control map in an engine control unit. The basic control map has a preset engine control amount contained therein. An engine control amount is set with an external setting unit. A start preparing operation of an engine in the motor vehicle is detected. The preset engine control amount is replaced with the engine control amount set by the external setting unit upon detection of the start preparing operation. The engine control amount set by the external setting unit is reflected in the basic control map.

In another embodiment, the invention can include a motor vehicle having an engine means for providing motive force to the motor vehicle. External setting means are provided for setting a control amount for the engine means. Control means are provided for storing a basic control map having a preset engine control amount contained therein. The control means is also for communicating with the external setting means. Engine setting means are provided for changing the preset engine control amount by replacing the preset engine control amount with the engine control amount set by the external setting means. The engine control amount set by the external setting means is reflected in the basic control map. The engine control amount set by the external setting means is reflected in the basic control map when a start preparing operation is detected.

DETAILED DESCRIPTION OF EMBODIMENTS

Next, embodiments according to the present invention will be discussed hereinafter with reference to the drawings.

Figure 1:
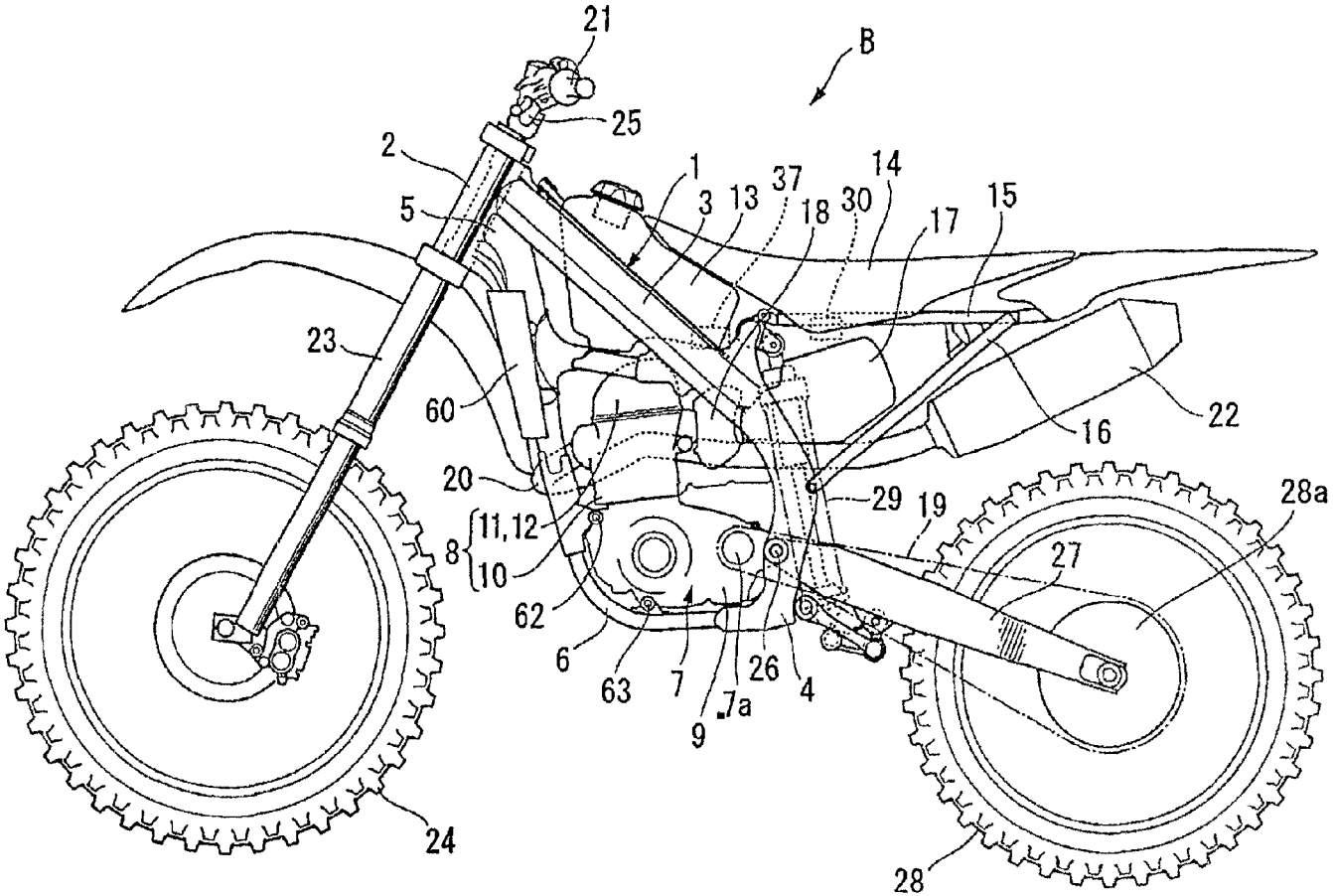
FIG. 1 is a side view of a motorcycle according to an embodiment of the present invention.

FIG. 1 is a side view illustrating a motorcycle provided with an engine setting system, according to an embodiment of the present invention.

This embodiment illustrates an off-road motorcycle; motorcycle B is, in this example, a battery-less vehicle. A vehicle body frame 1 of the motorcycle B can include a head pipe 2, main frames 3, center frames 4, a down frame 5 and lower frames 6. They can be connected in a loop-shape and support an engine 7 on inner sides thereof. The engine 7 is provided with at least one cylinder 8 and a crankcase 9. The main frames 3, the center frames 4 and the lower frames 6 are provided in pairs on the left and right sides. The single head pipe 2 and the single down frame 5 can be provided so as to be arranged along a center of the vehicle body.

The main frames 3 can extend rearward so as to linearly descend in an oblique direction in a position above the engine 7 and are connected to upper end portions of the center frames 4 vertically extending in a position behind the engine 7. The down frame 5 extends downward so as to descend in an oblique direction in a position before the engine 7 and is connected at a lower end portion thereof to forward end portions of the lower frames 6. The lower frames 6 are curved from a lower portion of a forward side of the engine 7 toward a downward direction of the engine 7, substantially linearly extend rearward, and are connected at rearward end portions thereof to lower end portions of the center frames 4.

The engine 7 can be of a water-cooled 4-cycle type. The cylinder 8 can be provided at a forward portion of the crankcase 9 in a standing-up state, where a cylinder axis line thereof can become substantially vertical, and provided with a cylinder block 10, a cylinder head 11, and a head cover 12 which are arranged sequentially in an upward direction from a downward direction. By causing the cylinder 8 to stand up, a length of the engine 7 in a forward/rearward direction is shortened and the engine 7 is configured so as to be suitable for the off-road vehicle.

A fuel tank 13 can be arranged above the engine 7 and supported on the main frames 3. The interior of the fuel tank 13 has a built-in type fuel pump (not shown) housed therein, from which high pressure fuel is supplied through a fuel supply pipe to a throttle body 18. A seat 14 is arranged behind the fuel tank 13 and supported on a seat rail 15 which extends rearward from upper ends of the center frames 4. A rear frame 16 is arranged below the seat rail 15. An air cleaner 17 is supported to the seat rail 15 and the rear frame 16. The intake of air into the cylinder head 11 from a rear side of the vehicle body is performed through the throttle body 18.

An exhaust pipe 20 can be provided at a forward portion of the cylinder 8. The exhaust pipe 20 extends forward of the crankcase 9 from the forward portion of the cylinder 8, is bent in a right side and runs rearward on the right side of the vehicle body. A muffler 22 extends rearward from the exhaust pipe 20. A rear end portion of the muffler 22 is supported by the rear frame 16.

A front fork 23 can be supported to the head pipe 2. A front wheel 24 which can be supported to a lower end portion of the front fork 23 is steered by a handlebar 25. Incidentally, grips 21 are mounted around left and right end portions of the handlebar 25 and the end portion on the right side can be configured as a throttle grip 21 (only the grip 21 on the left side is shown in FIG. 1). A forward end portion of a rear swing arm 27 can be swingably supported to the center frames by a pivot axis 26. A rear wheel 28 can be supported to a rear end portion of the rear swing arm 27 and driven by a drive chain 19 which is wound around a drive sprocket 7*a* of the engine 7 and a driven sprocket 28*a* of the rear wheel 28. The drive chain 19 is led along the rear swing arm 27 in the forward/rearward direction on the left side of the vehicle body which is opposite to the exhaust pipe 20, and can vertically travel to the vertical swinging movement of the rear swing arm 27 about the pivot axis 26. Moreover, a cushion unit 29 of a rear suspension is provided between the rear swing arm 27 and the rear end portions of the center frames 4.

Incidentally, in FIG. 1, reference numeral 60 denotes a radiator and reference numerals 62, 63 denote engine mount portions.

Under the seat 14, an ECU 30 can be provided as a control device. A connection terminal 37 for a USB (Universal Serial Bus), to which an external interface box 43 of an external device 40, discussed later, can be connected, is arranged at a lower portion of the fuel tank 13 inside the main frames 3.

Figure 2:
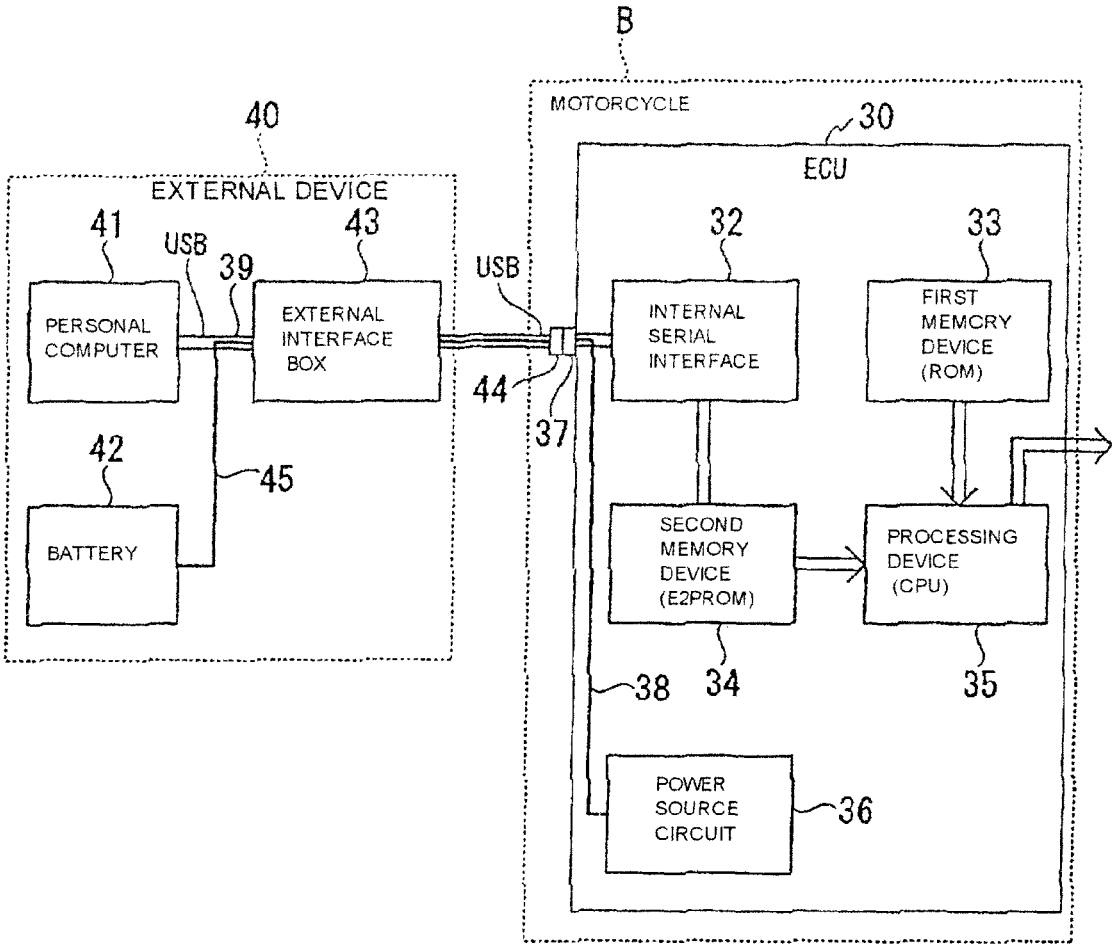
FIG. 2 is a block diagram of the embodiment according to the present invention.

FIG. 2 is a block diagram which illustrates the external device 40 and the engine setting system of the motorcycle B, according to an embodiment of the present invention. The ECU (Electronic Control Unit) 30 of the motorcycle B is provided with an internal serial interface 32, a first memory device 33 such as a ROM (read only memory), etc., a second memory device 34 such as E2PROM, etc., a processing device 35 such as a CPU, and a power source circuit 36. ROM 33 can be a special medium for reading-out. Moreover, the E2PROM means an electronically erasable and programmable read only memory and is mainly a non-volatile semiconductor memory.

The internal serial interface 32 can be provided with the USB connection terminal 37 arranged at the lower portion of the fuel tank 13 for connecting the internal serial interface 32 and a personal computer 41 of the external device 40 so as to be capable of making communication between the internal serial interface 32 and the personal computer 41, and is connected to the second memory device 34. The processing device 35 reads a basic control map and an engine control program which are previously stored in the first memory device 33 and also reads a correction coefficient map for correcting a basic control map which is an external setting data stored in the second memory device 34. The processing device 35 selects these basic control maps or the basic control map corrected on the basis of the correction efficient map, and controls the engine 7.

Engine control amount can be based upon data, such as an opening a throttle valve, an ambient temperature, an atmospheric pressure, a fuel injection quantity, an ignition time, an air-fuel ratio, an engine revolution number, a vehicle speed, etc. The basic control map is a map which is based on data on the vehicle which is previously set. The correction coefficient map is a correction coefficient map for correcting the basic control map, which the user sets so as to match his/her liking by the external device 40 discussed herein. Concretely, it can be an FI/IG correction coefficient map which maps a coefficient, by which the fuel injection quantity of the engine control amount is multiplied, and a coefficient, by which the ignition time is multiplied, according to the throttle opening TH and the engine revolution number NE.

Signals from sensors such as a throttle angle sensor, an ambient temperature sensor, an atmospheric pressure sensor, an engine revolution number sensor, a vehicle speed sensor, etc., which are not shown, can also be inputted into the ECU 30.

The power source circuit 36 which can be provided at the ECU 30 mainly provides a power source for writing data to the second memory device 34 and is connected through the USB connection terminal 37 to a power source line 38 of a USB line 39.

On the other hand, the external device 40 which is connected to the USB connection terminal 37 of the ECU 30 can be provided with the personal computer (PC) 41, a battery 42, and the external interface box 43. An external connection terminal 44 for the USB, which is connected to the USB connection terminal 37 of the ECU 30 is provided at the external interface box 43.

The personal computer 41 of the external device 40 can be connected through the USB line 39 to the external interface box 43. The external USB connection terminal 44 of the external interface box 43 is detachably connected to the connection terminal 37 of the ECU 30. Here, a power source line 45 of the battery 42 of the external device 40 is connected to the USB line 39 between the personal computer 41 and the external interface box 43 and supplies electric power to the power source circuit 36 provided at the ECU 30. The electric power from the battery 42 of the external device 40 may be supplied to the power source circuit 36 through another system, without going through the USB.

Therefore, though the basic control map at the time of starting of the engine is previously stored in the first memory device 33, the external connection terminal 44 of the external device 40 can be brought into a state where it is connected to the connection terminal 37 of the motorcycle B, if the user wishes to make a correction to the basic control map according to his/her liking. Then, the setting data (correction coefficient map) which are adjusted to his/her liking by the personal computer 41 of the external device 40 can be stored into the second memory device 34 of the ECU 30 from the external interface box 43. In this case, electric power required for storing the data into the second memory device 34 is supplied through the power source line 45 and the USB line 39 to the power source circuit 36 of the ECU 30 from the battery 42 of the external device 40, since the ECU 30 is carried on the battery-less motorcycle B.

Next, the operation of the embodiment according to the present invention will be discussed hereinafter with reference to a flow chart diagram of FIG. 3. The following process is mainly performed by the processing device 35.

When a kick or starting attempt is commenced in step S1, the supply of electric power to the ECU 30 is commenced in step S2. The supply of the electric power is performed by supplying generated electric power obtained by the generator to the ECU 30 through the regulator. A power source voltage which is applied to the ECU 30 is monitored in the ECU 30 which is then started, provided that the power source voltage becomes equal to or higher than a predetermined voltage in step S3, and reads the engine control program stored in the first memory device 33, and the engine control program is performed by the processing device 35. The performance of the engine control program is made based on the data of the basic control map which are read together with the engine control program.

Next, reading of the correction coefficient map stored in the second memory device 34, and adjusted to the user's preference, is commenced in step S4, and the process progresses to step S5. Here, the reading of the correction coefficient map stored in the second memory device 34 is a reading of the FI/IG correction coefficient map which is a setting value set by the user.

In the step S5, fuel injection is commenced based on the basic control map stored in the first memory device 33. In step S6, ignition is performed at a timing based on the basic control map, and the process progresses to step S7.

In the step S7, it is judged whether or not the inputting of the FI/IG correction coefficient map, stored in the second memory device 34, to the processing device 35 has been completed. If it is judged as the result of the judgment in the step S7 that the inputting has not been completed, the inputting of the FI/IG correction coefficient map is continued in step S12.

When it is judged as the result of the judgment in the step S7 that the inputting has been completed, the process progresses to step S8 in which it is judged whether or not the engine revolution number NE is equal to or more than a correction coefficient-applied judgment engine revolution number NE. This judgment is repeated until the engine revolution number becomes equal to or more than the correction coefficient-applied judgment engine revolution number NE.

Here, as the correction coefficient-applied judgment engine revolution number NE, an engine revolution number NE (=2300 rpm) which is higher than an idle revolution number NE (=1700 rpm) is set. This engine revolution number is an engine revolution number which reaches when the user performs a snap operation starting to open the throttle grip. Here, while a judgment on start preparing operation of the user is made by the judgment in the step S8 whether or not the engine revolution number NE is equal to or higher than the correction coefficient applied-judgment engine revolution number NE, the process may progress to step S9 in a case where the throttle opening θ is judged by a throttle angle sensor to be equal to or more than a predetermined opening (equal to or more than a correction coefficient applied-judgment throttle opening θTH). Incidentally, the case where the throttle opening θ is equal to or more than the predetermined opening (equal to or more than the correction coefficient applied-judgment throttle opening θTH) is shown in a time chart of FIG. 5.

In a case where the judgment in the step S8 is "YES", the snap operation which is the start preparing operation of the user is performed and the engine is subjected to perfect combustion explosion, so that it is judged that the start of the engine has been normally completed and, thus, the process progresses to the step S9 in which a correction coefficient that corresponds to the throttle opening TH and the engine revolution number NE is searched from the FI/IG correction coefficient map that has been inputted to the processing device 35 from the second memory device 34, and the process progresses to step S10.

In the step S10, fuel is injected based on a value which is obtained by multiplying the fuel injection quantity by the correction coefficient, and the process progresses to step S11 in which ignition is performed at an ignition time based on a value which is obtained by adding the correction coefficient to the ignition time, thus finishing the processing.

Figure 4:
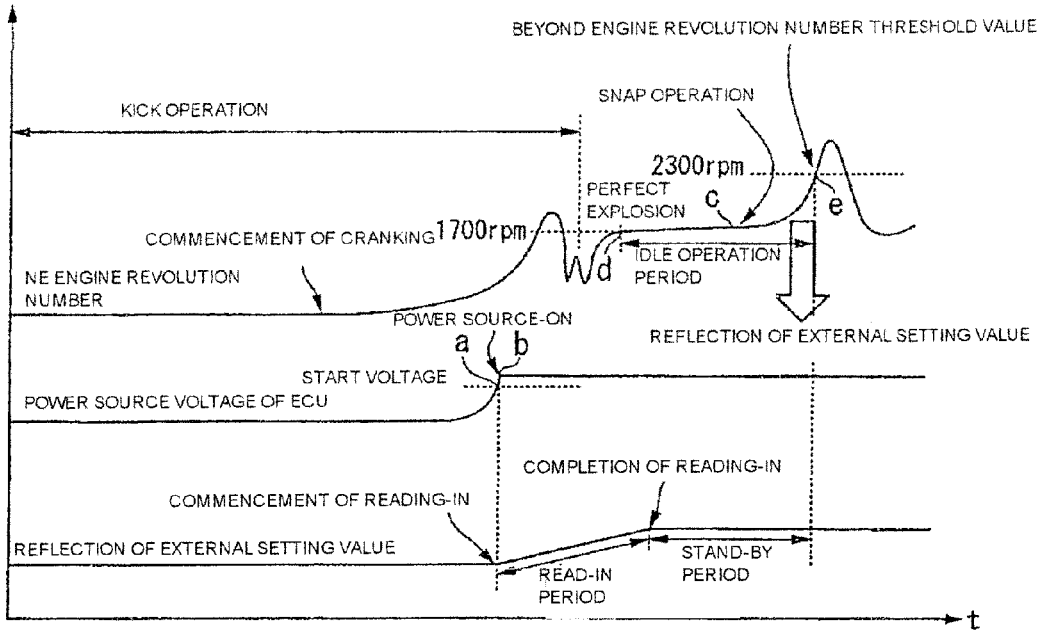
FIG. 4 is a time chart diagram of the embodiment according to the present invention.

FIG. 4 is a time chart diagram which illustrates the processing flow until the snap operation is performed from the kick operation, and a state where the engine revolution number NE, the power source voltage of the ECU, and an external setting value are read-in.

Figure 3:
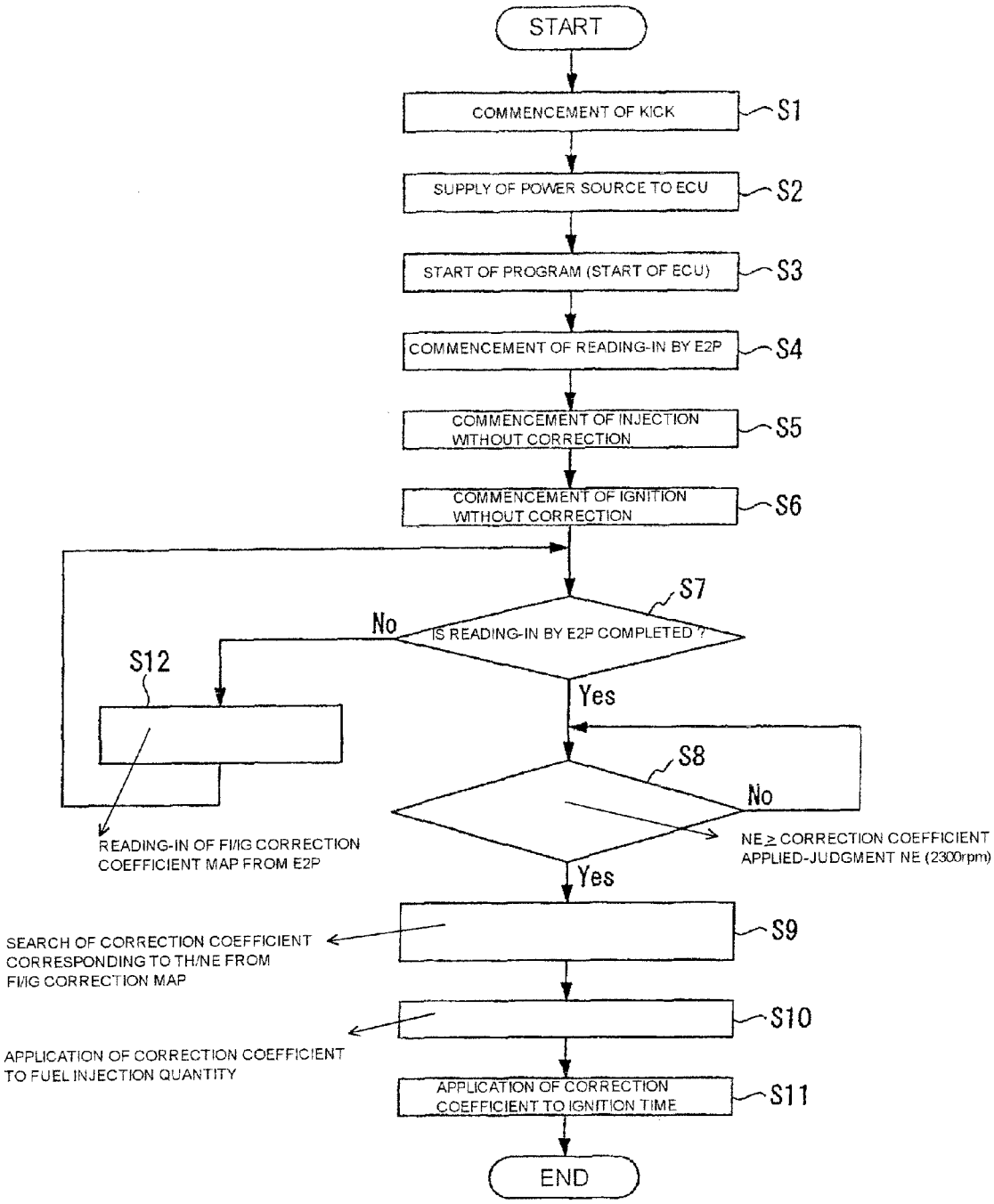
FIG. 3 is a flow chart diagram of the embodiment according to the present invention.

When cranking is commenced by the kick operation or other cranking operation (step S1 of FIG. 3), the engine revolution number NE is gradually increased and electric power is supplied to the ECU 30 (step S2 of FIG. 3). After the power source voltage of the ECU is commenced to be increased and exceeds a start voltage (point a), the power source becomes ON (point b). At the time (point a) that the power source voltage of the ECU exceeds the start voltage, the inputting of the FI/IG correction coefficient map, that is the external setting value, to the processing device 35 from the second memory device 34 is commenced. Here, when the power source voltage of the ECU becomes OFF due to insufficient kicking or insufficient revolutions during a period of this reading-in, the reading-in is re-performed from the beginning in a re-kicking or re-cranking operation.

Then, when the engine is subjected to the perfect combustion explosion at the engine revolution number of, for example 1700 rpm or so (point d: finishing of the perfect explosion), an idle-operation period is started. Immediately thereafter, the inputting of the FI/IG correction coefficient map, which is the external setting value, to the processing device 35 from the second memory device 34 is completed ("YES" in the step S7), and a stand-by period actually waiting for the start preparing operation by the user is started. Here, during the period from the kick operation to the stand-by period, stable starting and idle operation are performed based on the basic control map of the first memory device 33 which is previously set, and the starting has been substantially completed.

Then, when the engine revolution number NE becomes higher (point e) than an engine revolution number threshold value (correction coefficient applied-judgment NE in the step S8) of 2300 rpm which is higher than the idle revolution number (1700 rpm), by the snap operation (point c) that is the start preparing operation of the user (alternatively, by detection of increase in the throttle opening TH), and the starting state is positively released ("YES" in the step S7 of FIG. 3), operation in which the external setting value that is inputted to the processing device 35 from the second memory device 34 is reflected is performed. That is, operation is performed with the fuel injection quantity and the ignition time to which the correction coefficient set by the user is applied. Incidentally, though there is a case where the engine revolution number NE in the kick operation exceeds the idle revolution number, it does not exceed the engine revolution number threshold value (2300 rpm), so that the engine revolution number threshold value is set to an engine revolution that is higher than the idle revolution number and higher than the engine revolution number NE in the kick operation.

Here, in a case where the snap operation is performed immediately after the engine is subjected to the perfect combustion explosion, to thereby reflecting the external setting value and, thereafter, the idle operation is performed, this is performed after the engine revolution number is once increased by the snap operation, so that the idle operation is relatively stably performed even if the reflection of the external setting value is performed. Moreover, in a case where the snap operation is performed during the period of reading-in, the reflection of the external setting value is not performed and the snap operation negates.

Figure 5:
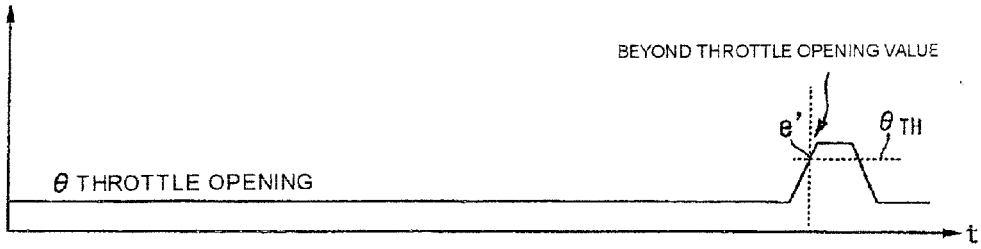
FIG. 5 is a time chart diagram of a throttle opening which is employed in lieu of the time chart diagram of an engine revolution number of FIG. 4.

FIG. 5 is a time chart diagram illustrating another mode of judgment on the start preparing operation of the user, which may be employed in lieu of the time chart of the engine revolution number in FIG. 4. Here, in order to facilitate understanding of a relationship between FIG. 5 and FIG. 4, the same length of the time axis as set in the FIG. 4 is set in FIG. 5.

While it is judged in FIG. 4 whether or not the engine revolution number NE is equal to or more than the correction coefficient applied-judgment engine revolution number NE, to thereby judge the start preparing operation of the user, it is possible to judge that the start preparing operation of the user is performed, in a case where it is detected by the throttle angle sensor that the throttle opening θ is equal to or more than the predetermined opening (equal to or more than the correction coefficient applied-judgment throttle opening θTH) as shown in FIG. 5. In this case, a point e' which joins to a line of the correction coefficient applied-judgment throttle opening θTH when the throttle opening is increased becomes a trigger for causing the process to progress to the step S9.

Therefore, according to this embodiment, the correction coefficient that corresponds to the throttle opening TH and the engine revolution number NE can be retrieved from the FI/IG correction coefficient map set by the user, after the start preparing operation of the user is detected ("YES" in the Step S8), and the fuel injection quantity and the ignition time are corrected, so that it is possible to prevent a situation in which the fuel injection quantity and the ignition time which are set and corrected by the user in an unstable state before the engine is subjected to the perfect explosion are used. Therefore, at the time of starting of the engine 7, it is possible to start the engine with the fuel injection quantity and the ignition time which correspond to the throttle opening TH and the engine revolution number NE which are obtained from the basic control map previously set, thus making it possible to improve the startability of the engine 7.

Moreover, it is possible to perform the judgment (step S8) on the start preparing operation by using an existing engine revolution number sensor for detecting the engine revolution number, so that no special new device is required to be used.

Moreover, during the idle operation period immediately after the engine starting in which an engine state is most likely to become unstable (operation near NE=1700 rpm), the correction coefficient map which the user sets using the personal computer 41 of the external device 40 is not reflected, and the idle operation is performed based on the basic control map, so that it is possible to prevent the idle operation state from becoming unstable.

Moreover, the start preparing operation can be judged based on positive starting-intention of the user for the snap operation opening the throttle grip, after the engine is subjected to the perfect explosion or simultaneously with the perfect explosion, so that it is possible to positively determine a timing of operation, using the corrected fuel injection quantity and ignition timing.

Even if the judgment on the start preparing operation is performed using the existing throttle angle sensor for detecting the throttle opening θ, no special new device is required to be used, like the case where the judgment on the start preparing operation is performed using the engine revolution number sensor.

Here, if the FI/IG correction coefficient map which is previously set by the personal computer 41 prior to the control of the engine, namely, immediately after the program is started in the step S3, is inputted from the second memory device 34 to the processing device 35 and brought into a stand-by state, it is possible to immediately consider the correction coefficient map when the start preparing operation after the start of the engine is detected, and to reflect it in the engine control. Therefore, it is possible to improve the responsiveness of the vehicle to the start preparing operation of the user.

This embodiment can be applied to the battery-less vehicle in which the engine state is easy to become unstable since the supply of electric power difficult at the time of the starting of the engine. An effect is obtained by the embodiment, such that the starting of the engine can be suitably performed, and the timing of reflection of the fuel injection quantity and the ignition time which are thereafter corrected so as to match the user's liking by the external setting can be made suitable.

The present invention is not limited to the above-mentioned embodiments and may be applied to, for example, a vehicle other than the battery-less motorcycle. Moreover, the idle revolution number of 1700 rpm and the correction coefficient applied-judgment engine revolution number of 2300 rpm are employed as examples, and they are not limited to these levels.

DESCRIPTION OF REFERENCE NUMERALS

21 . . . Throttle grip
30 . . . ECU (Control device)
34 . . . Second memory device (Memory means)
40 . . . External device (External setting means)
B . . . Motorcycle

We claim:

1. A motor vehicle, comprising:

an engine;

an external setting unit configured to set an engine control amount;

a control unit configured to store a basic control map having a preset engine control amount contained therein, the control unit is also configured to communicate with the external setting unit;

an engine setting system configured to change the preset engine control amount by replacing the preset engine control amount with the engine control amount set by the external setting unit, wherein the engine control amount set by the external setting unit is reflected in the basic control map;

an engine revolution detection unit connected to the control unit, wherein the engine control amount set by the external setting unit is reflected in the control map when a start preparing operation is detected, wherein the control unit determines an existence of a start preparing operation when an engine revolution number obtained from the engine revolution detection unit exceeds a predetermined value, and wherein the predetermined value is set to a revolution number that is higher than an idle revolution number.

2. A motor vehicle according to claim 1, wherein the predetermined value is based upon a snap operation opening a throttle grip.

3. A motor vehicle according to claim 1, wherein the control unit is configured to determine an existence of a start preparing operation when a throttle opening is detected to exceed a predetermined throttle opening value.

4. A motor vehicle according to claim 1, further comprising:

a memory device configured to store the engine control amount to be set by the external setting unit as a read-in amount, wherein the read-in amount is maintained in a stand-by-state until the start preparing operation begins.

5. A motor vehicle according to claim 1, wherein engine control is based upon the basic control map until the engine control amount set by the external setting unit is reflected.

6. A motor vehicle according to claim 1, wherein the motor vehicle comprises a battery-less motor vehicle.

7. A motor vehicle according to claim 6, wherein the motor vehicle comprises a motorcycle.

8. A method of controlling an engine, comprising:

storing a basic control map in an engine control unit, said basic control map having a preset engine control amount contained therein;

setting an engine control amount with an external setting unit;

detecting a start preparing operation of an engine in the motor vehicle;

replacing the preset engine control amount with the engine control amount set by the external setting unit upon detection of the start preparing operation, wherein the engine control amount set by the external setting unit is reflected in the basic control map, wherein the detecting comprises determining when an engine revolution number exceeds a predetermined value, and wherein the predetermined value comprises a revolution number that is higher than an idle revolution number.

9. A method according to claim 8, wherein the detecting comprises detecting when a throttle opening exceeds a predetermined throttle opening value.

10. A method according to claim 8, wherein the setting comprises setting the engine control amount based upon data received from a memory device.

11. Method according to claim 8, wherein engine control is based upon the basic control map until the engine control amount set by the external setting unit is reflected in the basic control map.

12. A motor vehicle, comprising:

engine means for providing motive force to a motor vehicle;

external setting means for setting a control amount for the engine means;

control means for storing a basic control map having a preset engine control amount contained therein, the control means also for communicating with the external setting means;

engine setting means for changing the preset engine control amount by replacing the preset engine control amount with the engine control amount set by the external setting means, wherein the engine control amount set by the external setting means is reflected in the basic control map;

engine revolution detecting means connected to the control means, for detecting an engine revolution amount, wherein the control means is also for determining an existence of a start preparing operation when an engine revolution number obtained from the engine revolution detection means exceeds a predetermined value, wherein the engine control amount set by the external setting means is reflected in the control map when a start preparing operation is detected, and wherein the predetermined value comprises a revolution number that is higher than an idle revolution number.

13. A motor vehicle according to claim 12, wherein the control means is also for determining an existence of a start preparation operation when a throttle opening is detected to exceed a predetermined throttle opening value.

14. A motor vehicle according to claim 12, further comprising: memory means for storing the engine control amount which is set by the external setting means as a read-in amount, wherein the read-in amount is stored in a stand-by-state until a start preparation operation is initiated.

* * * * *